US008534246B2

(12) United States Patent
Lichti et al.

(10) Patent No.: US 8,534,246 B2
(45) **Date of Patent: *Sep. 17, 2013**

(54) CAMSHAFT PHASER WITH INDEPENDENT PHASING AND LOCK PIN CONTROL

(75) Inventors: Thomas H. Lichti, Victor, NY (US); Thomas H. Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 256 days.

This patent is subject to a terminal disclaimer.

(21) Appl. No.: 13/082,458

(22) Filed: Apr. 8, 2011

(65) Prior Publication Data

US 2012/0255509 A1 Oct. 11, 2012

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/1, 2, 160
See application file for complete search history.

(56) References Cited

U.S. PATENT DOCUMENTS

| | | | | |
|---|---|---|---|---|
| 5,263,443 | A * | 11/1993 | Schechter et al. | 123/90.17 |
| 7,421,989 | B2 * | 9/2008 | Fischer et al. | 123/90.17 |
| 2002/0043230 | A1 | 4/2002 | Kinugawa | |
| 2004/0055550 | A1 | 3/2004 | Smith | |
| 2005/0066924 | A1 | 3/2005 | Lehmann et al. | |
| 2006/0086332 | A1 | 4/2006 | Simpson et al. | |
| 2009/0145386 | A1 | 6/2009 | Ushida | |
| 2009/0250028 | A1 | 10/2009 | Fujiyoshi et al. | |
| 2009/0312937 | A1 | 12/2009 | Pfeiffer | |
| 2010/0139592 | A1 | 6/2010 | Takemura | |
| 2010/0288215 | A1 | 11/2010 | Takemura et al. | |

FOREIGN PATENT DOCUMENTS

| | | | |
|---|---|---|---|
| DE | 10346443 | A1 | 5/2005 |
| DE | 202010006605 | U1 | 11/2010 |

OTHER PUBLICATIONS

English Translation of DE10346443.
European Search Report Dated Dec. 20, 2012.
Pending U.S. Appl. No. 12/912,338, filed Oct. 26, 2010.
Pending U.S. Appl. No. 13/049,167, filed Mar. 16, 2011.

* cited by examiner

*Primary Examiner* — Ching Chang
(74) *Attorney, Agent, or Firm* — Thomas N. Twomey

(57) ABSTRACT

A camshaft phaser is provided for varying the phase relationship between a crankshaft and a camshaft in an engine. The camshaft phaser includes a stator having lobes. A rotor disposed within the stator includes vanes interspersed with the stator lobes to define alternating advance and retard chambers. A lock pin is provided for selective engagement with a lock pin seat for preventing relative rotation between the rotor and stator. Pressurized oil disengages the lock pin from the seat while oil is vented for engaging the lock pin with the seat. A phase relationship control valve is located coaxially within the rotor to control the flow of oil into and out of the chambers. A lock pin oil passage communicates oil to and from the lock pin based on input from a lock pin control valve located outside of the camshaft phaser. The control valves are operational independent of each other.

24 Claims, 11 Drawing Sheets

CAMSHAFT PHASER WITH INDEPENDENT PHASING AND LOCK PIN CONTROL

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser, and more particularly to a vane-type camshaft phaser which includes a phase relationship control valve located coaxially within the camshaft phaser for varying the phase relationship between the crankshaft and the camshaft and a lock pin oil passage for communicating oil to and from a lock pin using a lock pin oil control valve located outside of the camshaft phaser.

BACKGROUND OF INVENTION

A typical vane-type camshaft phaser generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers in order to rotate the rotor within the stator and thereby change the phase relationship between an engine camshaft and an engine crankshaft. Camshaft phasers also commonly include an intermediate lock pin which selectively prevents relative rotation between the rotor and the stator at an angular position that is intermediate of a full advance and a full retard position. The intermediate lock pin is engaged and disengaged by venting oil from the intermediate lock pin and supplying pressurized oil to the intermediate lock pin respectively.

Some camshaft phasers utilize one or more oil control valves located in the internal combustion engine to control the flow of pressurized oil to and from the advance chambers, retard chambers, and lock pin. One example of such a camshaft phaser is shown in United States Patent Application Publication number 2010/0288215. In this arrangement, three separate supply signals need to be included in the camshaft bearing for communication to the camshaft phaser. More specifically, a first passage for the advance chambers, a second passage for the retard chambers, and a third passage for the lock pin are included in the camshaft bearing. Including three separate passages in the camshaft bearing undesirably increases the length of the camshaft bearing. Additionally, space may be limited in the internal combustion engine to package oil control valves therein which are needed to control oil to and from each of the three passages.

In order to eliminate the packaging concerns and increased camshaft bearing length issues associated with packaging the oil control valve in the internal combustion engine, some manufacturers have included the oil control valve coaxially within the camshaft phaser. While this arrangement works well for oil control valves that supply oil only to the advance and retard chambers, controlling a lock pin with the same valve provides disadvantages. One example of such a camshaft phaser is shown in United States Patent Application Publication number 2004/0055550. One disadvantage of including a single oil control valve coaxially within the camshaft phaser to control oil to the lock pin in addition to the advance and retard chambers is the increased camshaft phaser thickness that is needed in order to accommodate the passage supplying oil to and from the lock pin. A single oil control valve also prevents independent control of the lock pin function and the phasing function which may make engaging the intermediate lock pin with its lock pin seat difficult.

What is needed is an axially compact camshaft phaser with valving for controlling the phase relationship and for controlling the lock pin which does not require three separate supply passages in the camshaft bearing. What is also needed is such a camshaft phaser which allows for control of the oil used for changing the phase relationship independent of the oil used for controlling the lock pin.

SUMMARY OF THE INVENTION

Briefly described, a camshaft phaser is provided for controllably varying the phase relationship between a crankshaft and a camshaft in an internal combustion engine. The camshaft phaser includes a stator having a plurality of lobes and is connectable to the crankshaft of the internal combustion engine to provide a fixed ratio of rotation between the stator and the crankshaft. The camshaft phaser also includes a rotor coaxially disposed within the stator and having a plurality of vanes interspersed with the stator lobes defining alternating advance chambers and retard chambers. The advance chambers receive pressurized oil in order to change the phase relationship between the crankshaft and the camshaft in the advance direction while the retard chambers receive pressurized oil in order to change the phase relationship between the camshaft and the crankshaft in the retard direction. The rotor is attachable to the camshaft of the internal combustion engine to prevent relative rotation between the rotor and the camshaft. A lock pin is disposed within one of the rotor and the stator for selective engagement with the other of the rotor and stator for preventing a change in phase relationship between the rotor and the stator when the lock pin is engaged with the lock pin seat. Pressurized oil is selectively supplied to the lock pin in order to disengage the lock pin from the lock pin seat and oil is selectively vented from the lock pin in order to engage the lock pin with the lock pin seat. A phase relationship control valve is located coaxially within the rotor for controlling the flow of oil into and out of the advance and retard chambers. A lock pin oil passage is provided for communicating oil to and from the lock pin. The lock pin oil passage is connectable to a lock pin oil control valve located outside of the camshaft phaser when the camshaft phaser is attached to the internal combustion engine. The lock pin control valve controls the flow of oil to and from the lock pin and is operated independently of the phase relationship control valve.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which:

FIG. 4A' is an enlarged view of the pertinent elements of FIG. 4A without reference numbers to clearly shown the oil flow through the camshaft phaser;

FIG. 4B' is an enlarged view of the pertinent elements of FIG. 4B without reference numbers to clearly shown the oil flow through the camshaft phaser;

DETAILED DESCRIPTION OF INVENTION

Figure 1:
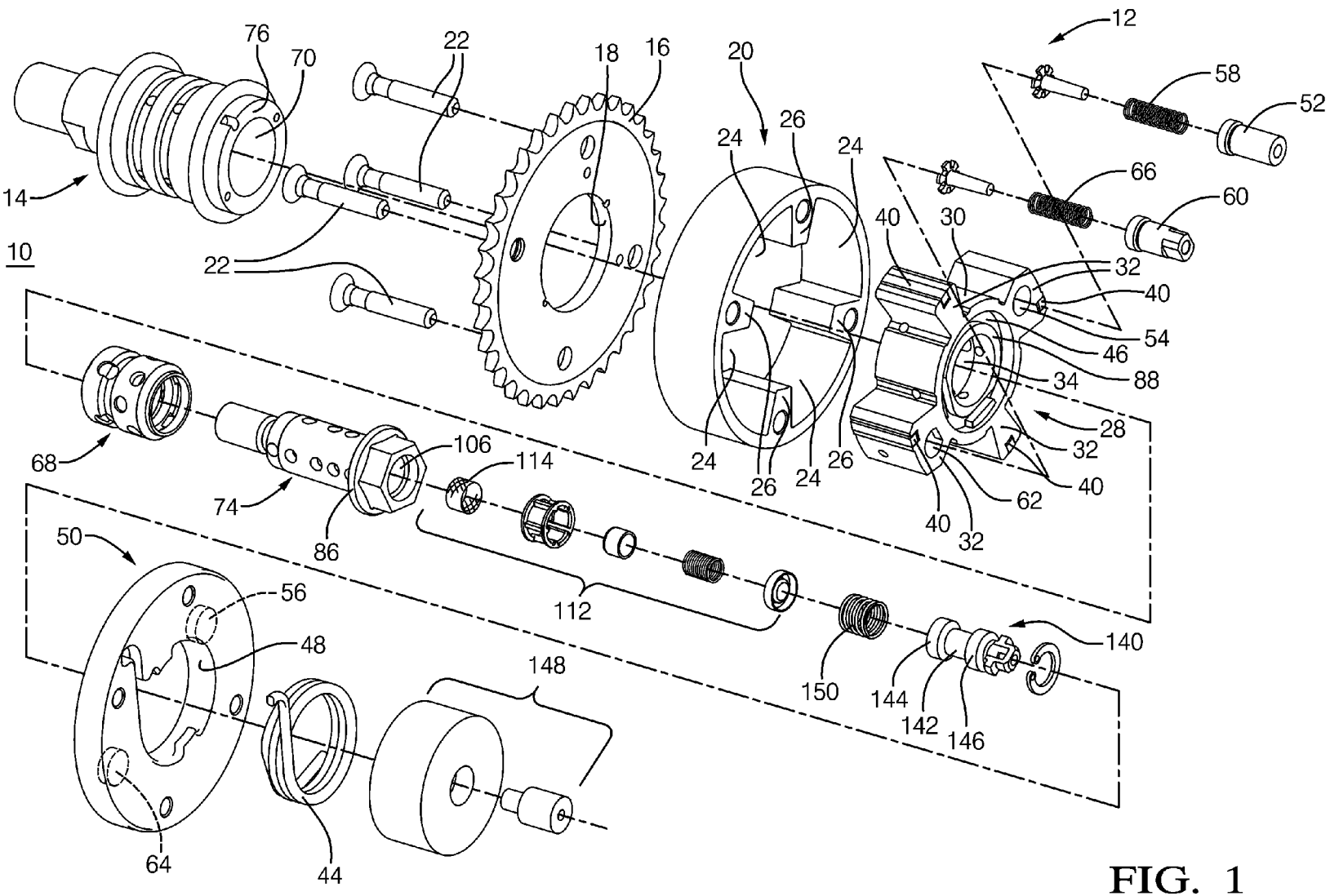
FIG. 1 is an exploded isometric view of a camshaft phaser in accordance with the present invention.
Figure 2:
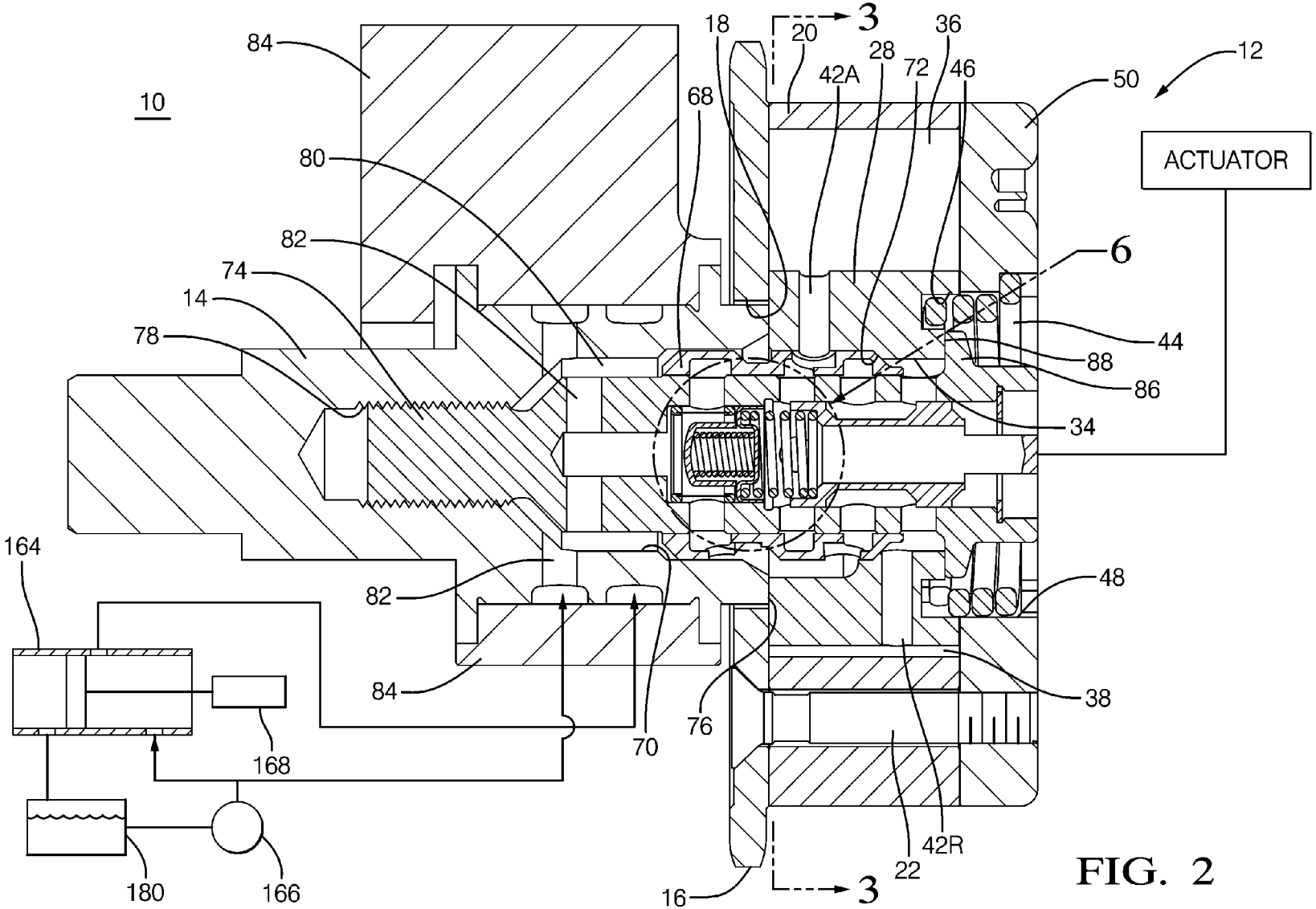
FIG. 2 is an axial cross-section of the camshaft phaser of FIG. 1.
Figure 3:
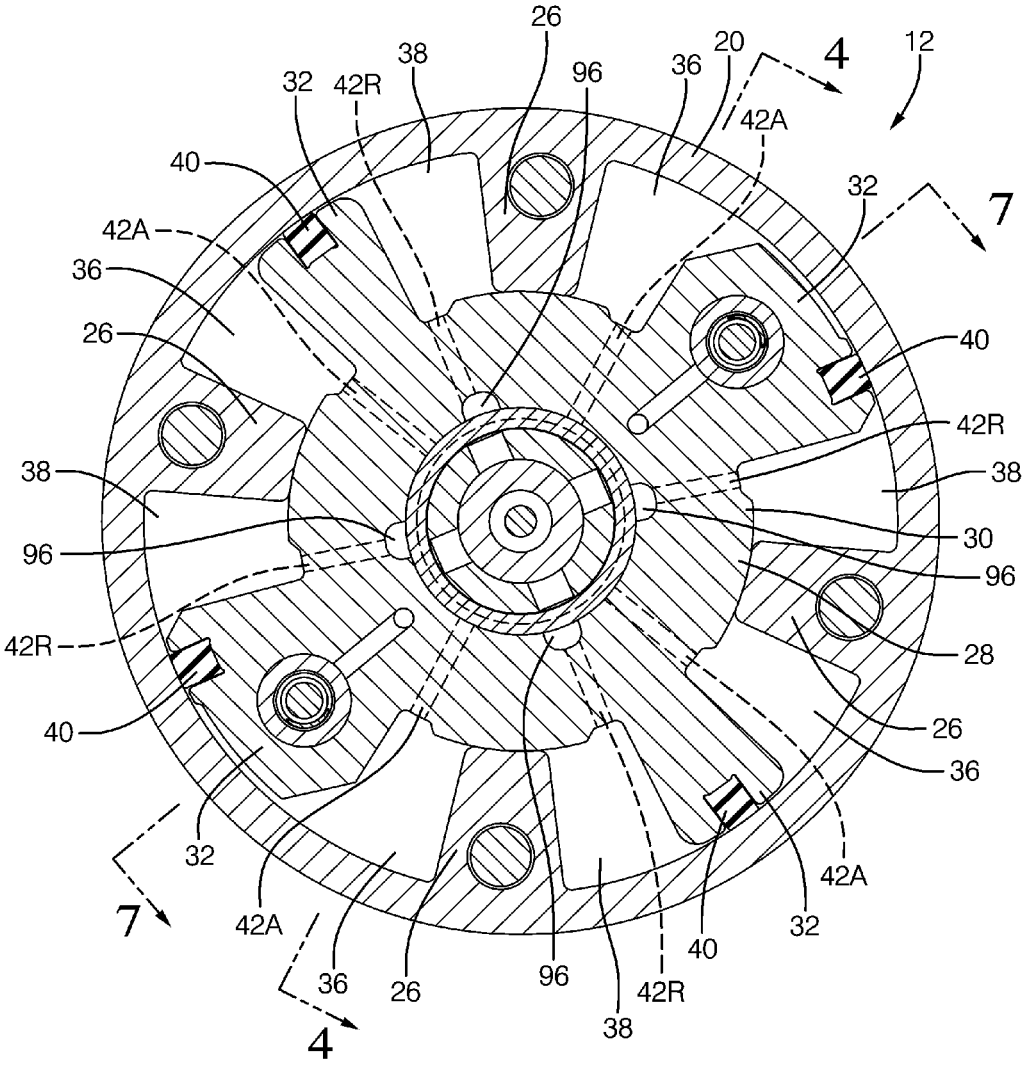
FIG. 3 is a radial cross-section of the camshaft phaser in accordance with the present invention taken in the direction of arrows 3 in FIG. 2.

In accordance with a preferred embodiment of this invention and referring to FIGS. 1, 2, and 3, internal combustion engine 10 is shown which includes camshaft phaser 12. Internal combustion engine 10 also includes camshaft 14 which is rotatable based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 includes sprocket 16 which is driven by a chain or gear (not shown) driven by the crankshaft of internal combustion engine 10. Alternatively, sprocket 16 may be a pulley driven by a belt. Sprocket 16 includes a central bore 18 for receiving camshaft 14 coaxially therethrough which is allowed to rotate relative to sprocket 16. Sprocket 16 is sealingly secured to stator 20 with sprocket bolts 22 in a way that will be described in more detail later.

Stator 20 is generally cylindrical and includes a plurality of radial chambers 24 defined by a plurality of lobes 26 extending radially inward. In the embodiment shown, there are four lobes 26 defining four radial chambers 24, however, it is to be understood that a different number of lobes may be provided to define radial chambers equal in quantity to the number of lobes.

Rotor 28 includes central hub 30 with a plurality of vanes 32 extending radially outward therefrom and central through bore 34 extending axially therethrough. The number of vanes 32 is equal to the number of radial chambers 24 provided in stator 20. Rotor 28 is coaxially disposed within stator 20 such that each vane 32 divides each radial chamber 24 into advance chambers 36 and retard chambers 38. The radial tips of lobes 26 are mateable with central hub 30 in order to separate radial chambers 24 from each other. Preferably, each of the radial tips of vanes 32 includes one of a plurality of wiper seals 40 to substantially seal adjacent advance and retard chambers 36, 38 from each other. Although not shown, each of the radial tips of lobes 26 may include a wiper seal similar in configuration to wiper seal 40.

Central hub 30 includes a plurality of oil passages 42A, 42R formed radially therethrough (best visible as hidden lines in FIG. 3). Each one of the plurality of oil passages 42A is in fluid communication with one of the advance chambers 36 for supplying oil thereto and therefrom while each one of the plurality of oil passages 42R is in fluid communication with one of the retard chambers 38 for supplying oil thereto and therefrom.

Bias spring 44 is disposed within annular pocket 46 formed in rotor 28 and within central bore 48 of camshaft phaser cover 50. Bias spring 44 is grounded at one end thereof to camshaft phaser cover 50 and is attached at the other end thereof to rotor 28. When internal combustion engine 10 is shut down, bias spring 44 urges rotor 28 to a predetermined angular position within stator 20 in a way that will be described in more detail in the subsequent paragraph.

Camshaft phaser 12 includes a staged dual lock pin system for selectively preventing relative rotation between rotor 28 and stator 20 at the predetermined angular position which is between the extreme advance and extreme retard positions. Primary lock pin 52 is slidably disposed within primary lock pin bore 54 formed in one of the plurality of vanes 32 of rotor 28. Primary lock pin seat 56 is formed in camshaft phaser cover 50 for selectively receiving primary lock pin 52 therewithin. Primary lock pin seat 56 is larger than primary lock pin 52 to allow rotor 28 to rotate relative to stator 20 about 5° on each side of the predetermined angular position when primary lock pin 52 is seated within primary lock pin seat 56. The enlarged nature of primary lock pin seat 56 allows primary lock pin 52 to be easily received therewithin. When primary lock pin 52 is not desired to be seated within primary lock pin seat 56, pressurized oil is supplied to primary lock pin 52, thereby urging primary lock pin 52 out of primary lock pin seat 56 and compressing primary lock pin spring 58. Conversely, when primary lock pin 52 is desired to be seated within primary lock pin seat 56, the pressurized oil is vented from primary lock pin 52, thereby allowing primary lock pin spring 58 to urge primary lock pin 52 toward camshaft phaser cover 50. In this way, primary lock pin 52 is seated within primary lock pin seat 56 by primary lock pin spring 58 when rotor 28 is positioned within stator 20 to allow alignment of primary lock pin 52 with primary lock pin seat 56.

Secondary lock pin 60 is slidably disposed within secondary lock pin bore 62 formed in one of the plurality of vanes 32 of rotor 28. Secondary lock pin seat 64 is formed in camshaft phaser cover 50 for selectively receiving secondary lock pin 60 therewithin. Secondary lock pin 60 fits within secondary lock pin seat 64 in a close sliding relationship, thereby substantially preventing relative rotation between rotor 28 and stator 20 when secondary lock pin 60 is received within secondary lock pin seat 64. When secondary lock pin 60 is not desired to be seated within secondary lock pin seat 64, pressurized oil is supplied to secondary lock pin 60, thereby urging secondary lock pin 60 out of secondary lock pin seat 64 and compressing secondary lock pin spring 66. Conversely, when secondary lock pin 60 is desired to be seated within secondary lock pin seat 64, the pressurized oil is vented from the secondary lock pin 60, thereby allowing secondary lock pin spring 66 to urge secondary lock pin 60 toward camshaft phaser cover 50. In this way, secondary lock pin 60 is seated within secondary lock pin seat 64 by secondary lock pin spring 66 when rotor 28 is positioned within stator 20 to allow alignment of secondary lock pin 60 with secondary lock pin seat 64.

When it is desired to prevent relative rotation between rotor 28 and stator 20 at the predetermined angular position, the pressurized oil is vented from both primary lock pin 52 and secondary lock pin 60, thereby allowing primary lock pin spring 58 and secondary lock pin spring 66 to urge primary and secondary lock pins 52, 60 respectively toward camshaft phaser cover 50. In order to align primary and secondary lock pins 52, 60 with primary and secondary lock pin seats 56, 64 respectively, rotor 28 may be rotated with respect to stator 20 by one or more of supplying pressurized oil to advance chambers 36, supplying pressurized oil to retard chambers 38, urging from bias spring 44, and torque from camshaft 14. Since primary lock pin seat 56 is enlarged, primary lock pin 52 will be seated within primary lock pin seat 56 before secondary lock pin 60 is seated within secondary lock pin seat 64. With primary lock pin 52 seated within primary lock pin seat 56, rotor 28 is allowed to rotate with respect to stator 20 by about 10°. Rotor 28 may be further rotated with respect to stator 20 by one or more of supplying pressurized oil to advance chambers 36, supplying pressurized oil to retard chambers 38, urging from bias spring 44, and torque from camshaft 14 in order to align secondary lock pin 60 with secondary lock pin seat 64, thereby allowing secondary lock pin 60 to be seated within secondary lock pin seat 64. Supply and venting of oil to and from advance chambers 36, retard chambers 38, and primary and secondary lock pins 52, 60 will be described in more detail later.

Camshaft phaser cover 50 is sealingly attached to stator 20 by sprocket bolts 22 that extend through sprocket 16 and stator 20 and threadably engage camshaft phaser cover 50. In this way, stator 20 is securely clamped between sprocket 16 and camshaft phaser cover 50 in order to axially and radially secure sprocket 16, stator 20, and camshaft cover 50 to each other.

Now referring to FIGS. 1, 2, 5*a*, and 5B, bushing adaptor 68 is coaxially disposed within pocket 70 of camshaft 14 in a close fitting relationship. Bushing adaptor 68 is also coaxially disposed within central through bore 34 of rotor 28 in a press fit relationship to prevent relative rotation therebetween and may be press fit within central through bore 34 until bushing adaptor 68 abuts stop surface 72 of central through bore 34 which is defined by the stepped nature of central through bore 34. When camshaft phaser 12 is attached to camshaft 14, bushing adaptor 68 coaxially aligns camshaft phaser 12 with camshaft 14. This allows the rotor 28 to be made more axially compact because axial space is not needed within rotor 28 for receiving camshaft 14 therewithin in order to coaxially align camshaft phaser 12 with camshaft 14. A network of oil passages is defined in part by bushing adaptor 68 in a way that will be described in detail later.

Camshaft phaser 12 is attached to camshaft 14 with camshaft phaser attachment bolt 74 which extends axially through bushing adaptor 68 in a close fitting relationship. Rotor 28 is positioned against axial face 76 of camshaft 14 which is provided with threaded hole 78 extending axially into camshaft 14 from pocket 70.

Annular oil chamber 80 is formed radially between camshaft phaser attachment bolt 74 and pocket 70 for receiving oil from camshaft phasing oil passages 82 formed radially through camshaft 14. Oil is supplied to camshaft oil passages 82 from internal combustion engine 10 through an oil gallery (not shown) in camshaft bearing 84. When camshaft phaser attachment bolt 74 is tightened to a predetermined torque, head 86 of camshaft phaser attachment bolt 74 acts axially on bolt surface 88 of rotor 28. In this way, camshaft phaser 12 is axially secured to camshaft 14 and relative rotation between rotor 28 and camshaft 14 is thereby prevented.

Now referring to FIGS. 1, 3, 4A, 5A, and 5B, bushing adaptor 68 defines, at least in part, supply passage 90 for communicating pressurized oil from internal combustion engine 10 to phase relationship control valve 92. Supply passage 90 may be defined in part by first annular groove 94 formed on the inside diameter of bushing adaptor 68. First annular groove 94 may be positioned axially within rotor 28.

Supply passage 90 may be further defined by axial grooves 96 which extend axially part way into central hub 30 of rotor 28. Axial grooves 96 may be in fluid communication with first annular groove 94 through first connecting passages 98 which extend radially through bushing adaptor 68.

Supply passage 90 may be further defined by second annular groove 100 formed on the inside diameter of bushing adaptor 68 and which may be positioned axially within pocket 70 of camshaft 14. Second annular groove 100 may be in fluid communication with axial grooves 96 through second connecting passages 102 which extend radially through bushing adaptor 68.

Supply passage 90 may be further defined by third annular groove 104 formed on the outside diameter of bushing adaptor 68 and axially between first annular groove 94 and second annular groove 100. Third annular groove 104 may be in fluid communication with second annular groove 100 through second connecting passages 102 and may also be in fluid communication with axial grooves 96 by axially positioning third annular groove 104 on the outside diameter of bushing adaptor 68 such that axial grooves 96 at least partly overlap axially with third annular groove 104.

Supply passage 90 may be further defined by blind bore 106 formed axially within camshaft phaser attachment bolt 74. Blind bore 106 begins at the end of camshaft phaser attachment bolt 74 defined by head 86 and may extend to a point within camshaft phaser attachment bolt 74 that is axially aligned with annular oil chamber 80. First radial drillings 108 extend radially through camshaft phaser attachment bolt 74 and provide fluid communication from annular oil chamber 80 to blind bore 106 while second radial drillings 110 are spaced axially apart from first radial drillings 108 and extend radially through camshaft phaser attachment bolt 74 to provide fluid communication from blind bore 106 to second annular groove 100.

Check valve assembly 112 may be disposed axially between first radial drillings 108 and second radial drillings 110 in order to allow pressurized oil to be supplied from internal combustion engine 10 to phase relationship control valve 92 while preventing oil from back-flowing from phase relationship control valve 92 to internal combustion engine 10. Check valve assembly 112 includes filter 114 in order to prevent any foreign matter that may present in the pressurized oil from reaching phase relationship control valve 92. Check valve assembly 112 is describe in more detail in U.S. patent application Ser. No. 12/912,338 which is commonly assigned to Applicant and which is incorporated herein by reference in its entirety.

Camshaft phaser attachment bolt 74 includes supply drillings 116 extending radially therethrough for providing fluid communication between first annular groove 94 and blind bore 106. Supply drillings 116 allow pressurized oil to be supplied to phase relationship control valve 92.

In addition to defining at least in part supply passage 90, bushing adaptor 68 also defines at least in part advance passage 118 for selectively communicating pressurized oil from phase relationship control valve 92 to advance chambers 36 and for venting oil therefrom. Advance passage 118 may be defined at least in part by fourth annular groove 120 formed on the inside diameter of bushing adaptor 68 and axially between first annular groove 94 and second annular groove 100. Through advance oil connecting passages 122, fourth annular groove 120 is in fluid communication with oil passages 42A that are in fluid communication advance chambers 36. Advance oil connecting passages 122 extend axially from fourth annular groove 120 through bushing adaptor 68.

Camshaft phaser attachment bolt 74 includes advance drillings 124 extending radially therethrough for providing fluid communication between fourth annular groove 120 and blind bore 106. Advance drillings 124 allow pressurized oil to be selectively supplied from phase relationship control valve 92 to advance chambers 36.

In addition to defining at least in part supply passage 90 and advance passage 118, bushing adaptor 68 also defines at least in part retard passage 126 for selectively communicating pressurized oil from phase relationship control valve 92 to retard chambers 38. Retard passage 126 may be defined by axial space 128 formed axially between axial end 130 of bushing adapter 68 and head 86. Axial end 130 may be defined by reduced diameter section 132 of bushing adapter 68 which provides radial clearance between central through bore 34 of rotor 28 and reduced diameter section 132. Axial space 128 is further defined radially between rotor 28 and camshaft phaser attachment bolt 74. Axial space 128 is in fluid communication with oil passages 42R that are in fluid communication with retard chambers 38.

Camshaft phaser attachment bolt 74 includes retard drillings 134 extending radially through camshaft phaser attachment bolt 74 for providing fluid communication between axial space 128 and blind bore 106. Retard drillings 134 allow pressurized oil to be selectively supplied from phase relationship control valve 92 to retard chambers 38.

Phase relationship control valve 92 is disposed within camshaft phaser attachment bolt 74 and retained therein by retaining ring 136 which fits within groove 138 of camshaft phaser attachment bolt 74. Phase relationship control valve 92 includes valve spool 140 with body 142 that is generally cylindrical, hollow and dimensioned to provide annular clearance between body 142 and blind bore 106 of camshaft attachment bolt 74.

Valve spool 140 also includes advance land 144 extending radially outward from body 142 for selectively blocking fluid communication between supply drillings 116 and advance drillings 124. Advance land 144 fits within blind bore 106 of camshaft phaser attachment bolt 74 in a close fitting relationship to substantially prevent oil from passing between advance land 144 and blind bore 106.

Valve spool 140 also includes retard land 146 extending radially outward from body 142 for selectively blocking fluid communication between supply drillings 116 and retard drillings 134. Retard land 146 is positioned axially away from advance land 144 and fits within blind bore 106 of camshaft phaser attachment bolt 74 in a close fitting relationship to substantially prevent oil from passing between retard land 146 and blind bore 106.

Figure 4A:
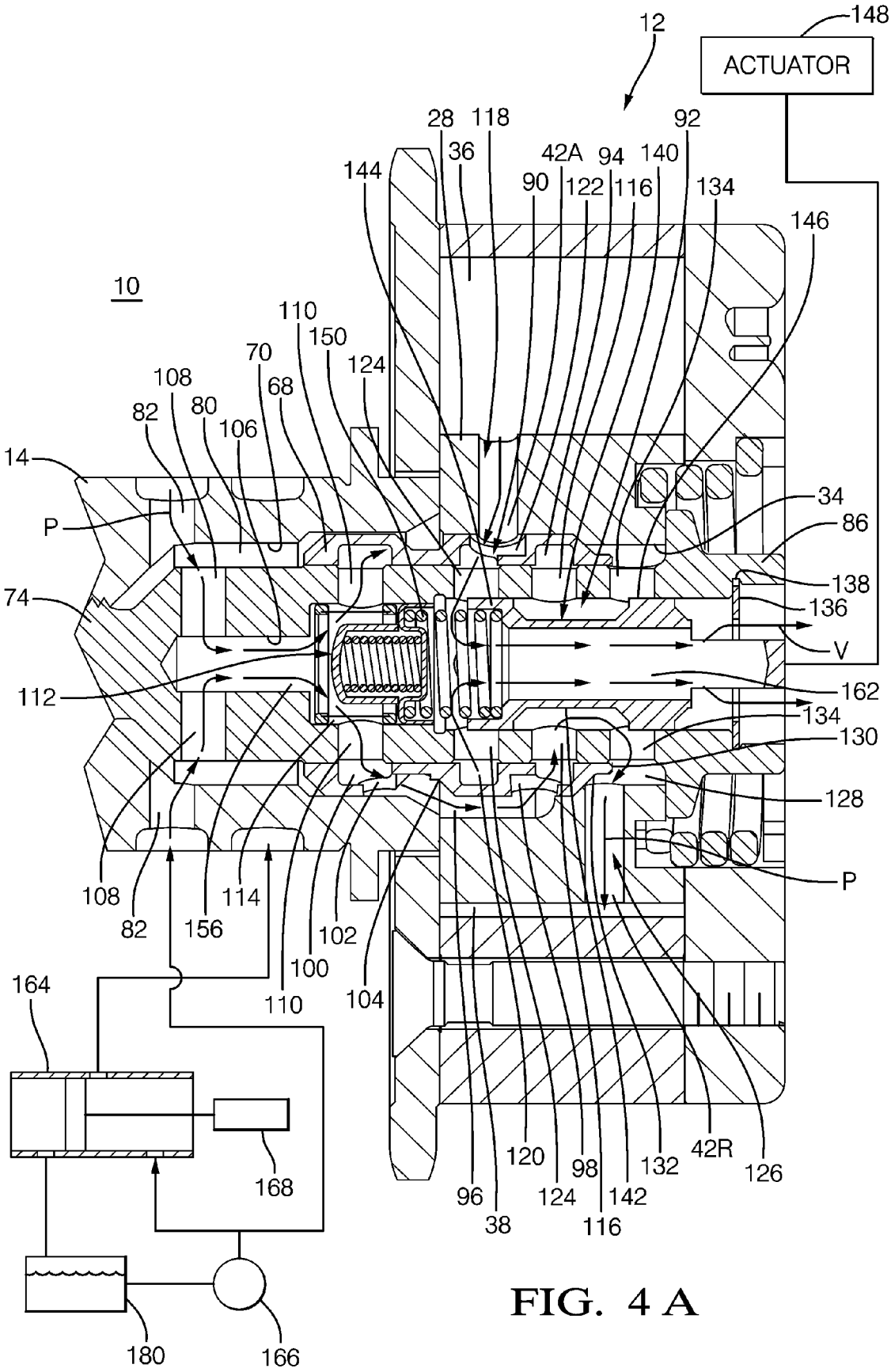
FIG. 4A is an axial cross-section of the camshaft phaser of FIG. 1 taken through section line 4-4 as shown in FIG. 3 and showing the phase relationship control valve in a first position for supplying pressurized oil to the retard chambers and for venting oil from the advance chambers.
Figure 4:
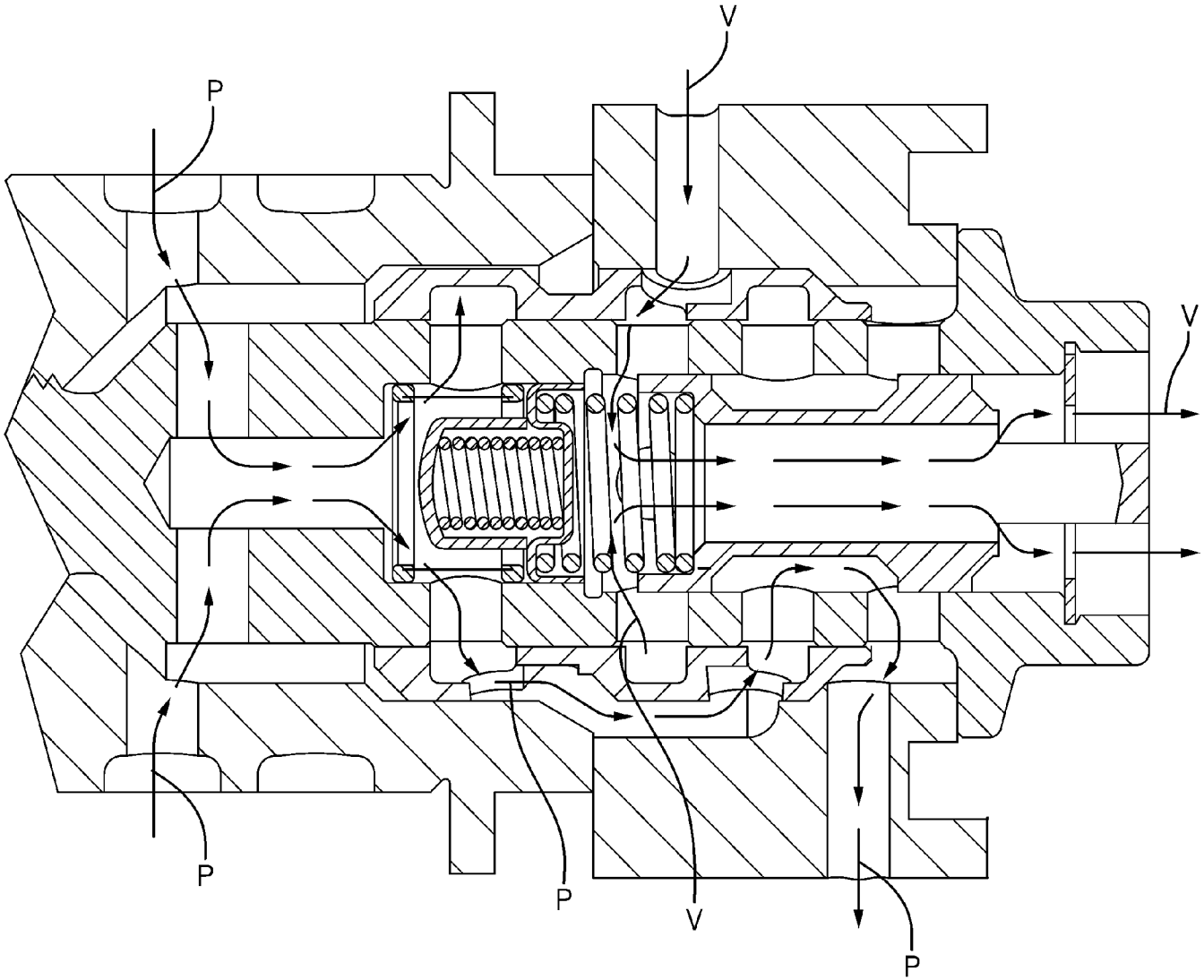
FIG. 4B is the axial cross section of FIG. 4A showing the phase relationship control valve in a second position for supplying pressurized oil to the advance chambers and for venting oil from the retard chambers.
Figure 6:
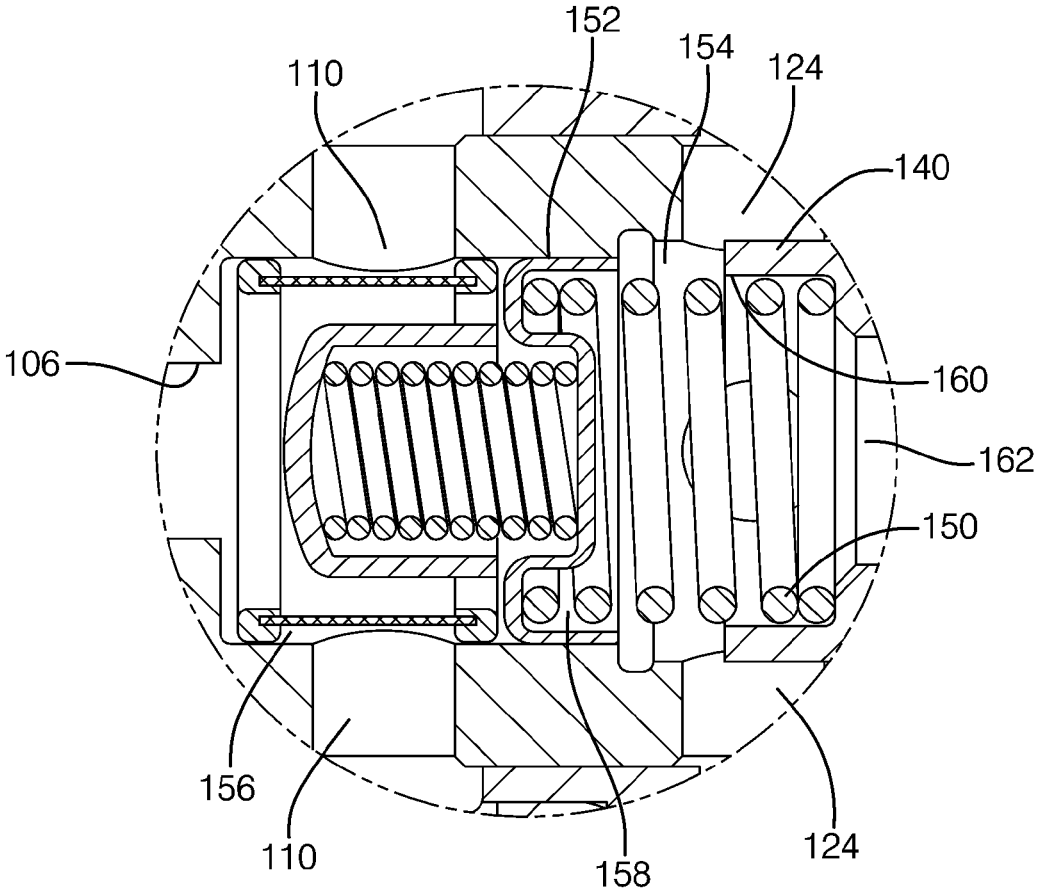
FIG. 6 is an enlarged view of circle 6 from FIG. 2.

Now referring to FIGS. 1, 4A, and 6, valve spool 140 is axially moveable within blind bore 106 with input from phase relationship control valve actuator 148 and spool spring 150. Spool spring 150 is grounded to camshaft phaser attachment bolt 74 by seat 152 which is sealingly fixed within blind bore 106 between second radial drillings 110 and advance drillings 124. Seat 152 sealingly separates blind bore 106 into spool section 154 and check valve section 156. A first end of spool spring 150 is seated within annular recess 158 of seat 152 while a second end of spool spring 150 is seated within spring pocket 160 formed in an end of valve spool 140. In this way, spool spring 150 biases valve spool 140 away from seat 152 when phase relationship control valve actuator 148 is not energized, thereby positioning valve spool 140 within spool section 154 such that pressurized oil is supplied to retard drillings 134 from supply drillings 116 while oil is vented from advance drillings 124 through central passage 162 of valve spool 140 and through the end of blind bore 106 that is adjacent to head 86. In contrast, when phase relationship control valve actuator 148 is energized, the biasing force of spool spring 150 is overcome to position valve spool 140 within spool section 154 such that pressurized oil is supplied to advance drillings 124 while oil is vented from retard drillings 134 to the end of blind bore 106 that is adjacent to head 86.

Figure 7A:
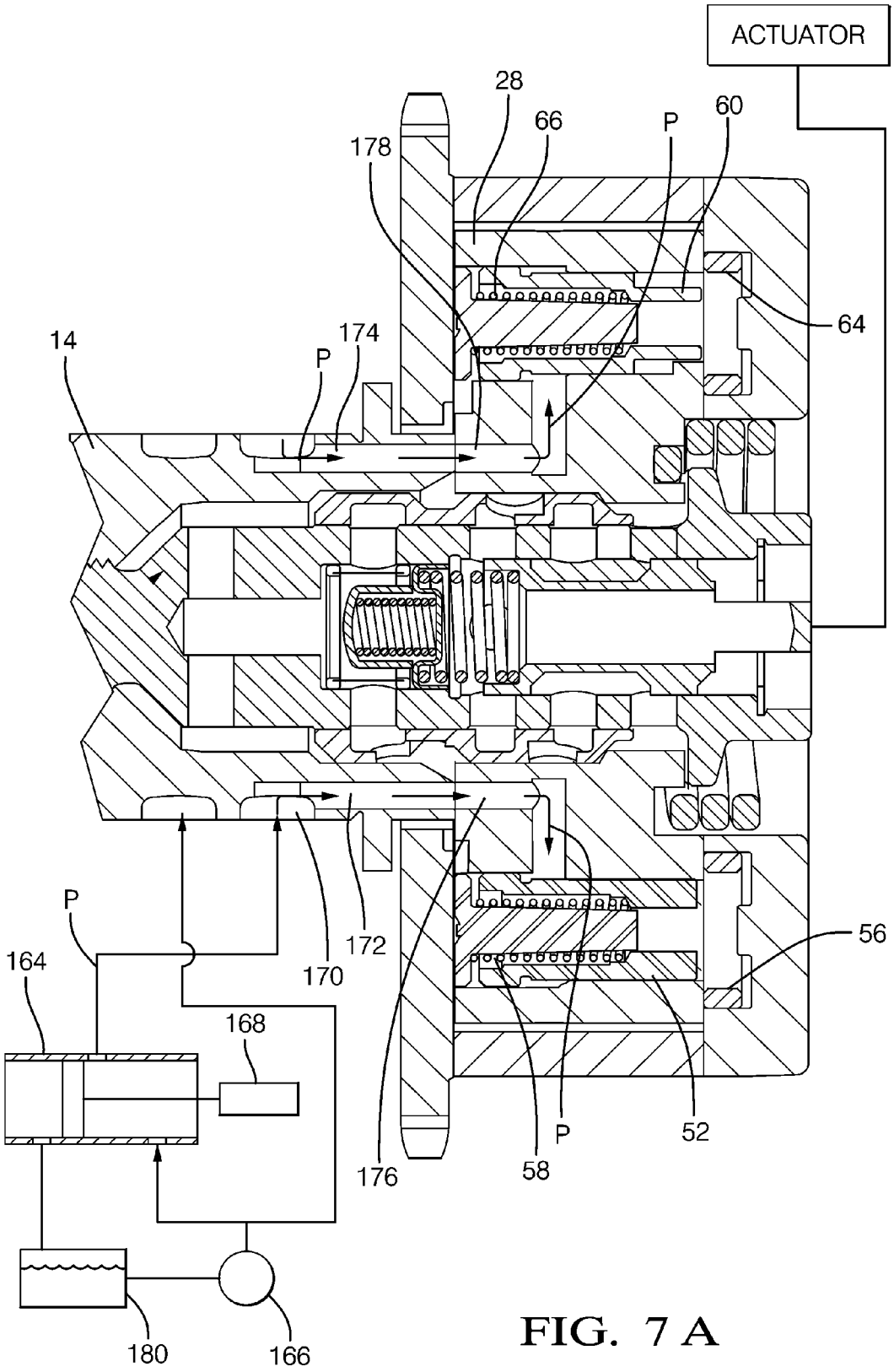
FIG. 7A is an axial cross-section of the camshaft phaser of FIG. 1 taken through section line 7-7 as shown in FIG. 3 and showing the lock pin control valve in an oil supplying position for supplying pressurized oil to the primary and secondary lock pins.
Figure 7B:
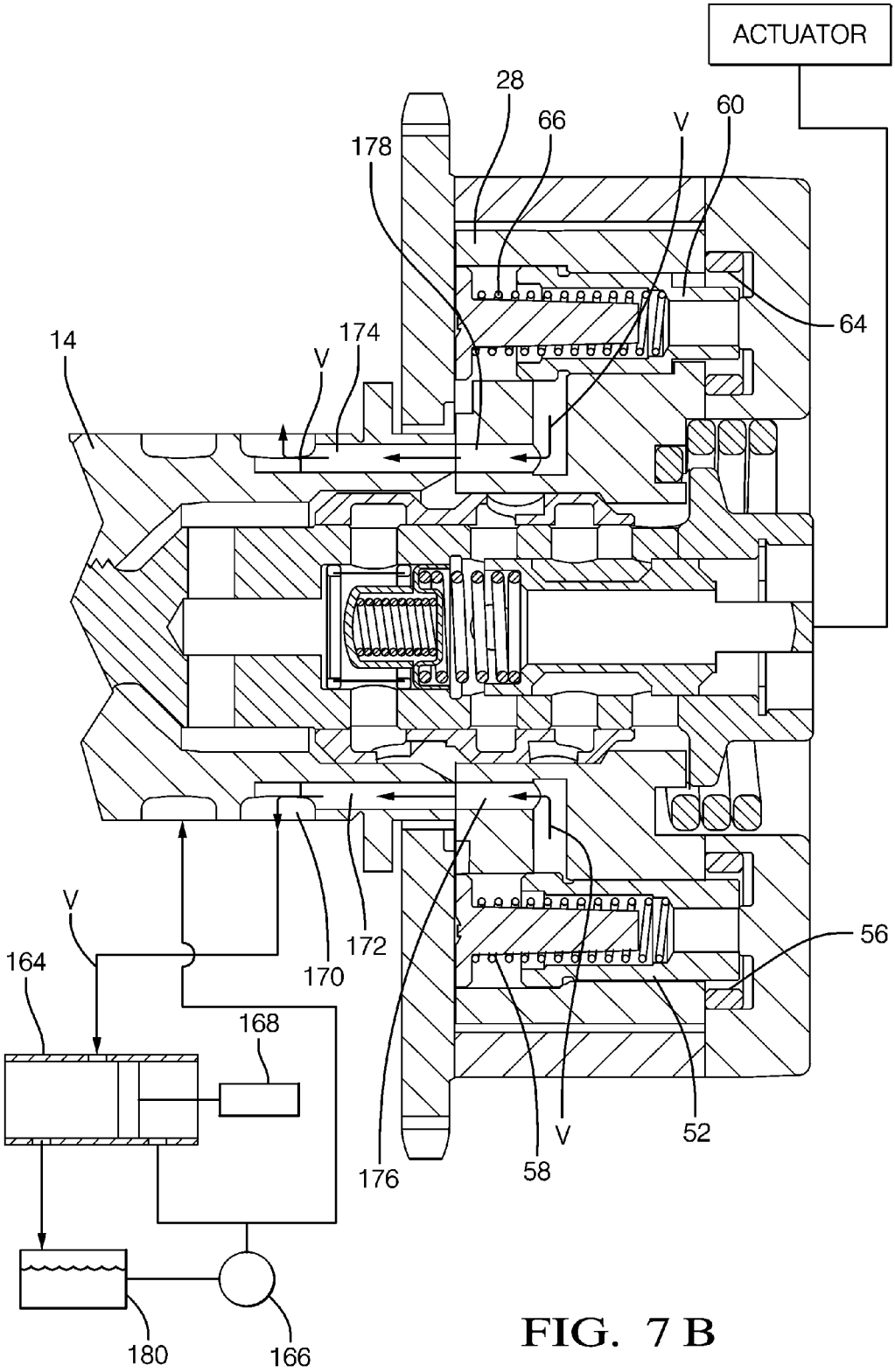
FIG. 7*b* the an axial cross-section of the FIG. 7A showing the lock pin control valve in an oil venting position for venting oil from the primary and secondary lock pins.

Now referring to FIGS. 4A, 7A, and 7B; lock pin control valve 164 is shown schematically and which is a conventional 3-way valve which is known in the art. Lock pin control valve 164 is located outside and remote from camshaft phaser 12 and is preferably located within internal combustion engine 10. Lock pin control valve 164 received pressurized oil from pump 166 which preferably also supplies pressurized oil to phase relationship control valve 92. Lock pin control valve actuator 168 moves lock pin control valve 164 between an oil supplying position and an oil venting position.

In the oil supplying position, as shown in FIG. 7A, pressurized oil from pump 166 is passed through lock pin control valve 164 and is supplied to annular lock pin oil groove 170 formed circumferentially around camshaft 14 and which is in fluid communication with camshaft primary lock pin oil passage 172 and camshaft secondary lock pin oil passage 174 formed axially through camshaft 14. Camshaft primary lock pin oil passage 172 is aligned with rotor primary lock pin oil passage 176 which is formed through rotor 28 and which is in fluid communication with primary lock pin 52. Similarly, camshaft secondary lock pin oil passage 174 is aligned with rotor secondary lock pin oil passage 178 which is formed through rotor 28 and which is in fluid communication with secondary lock pin 60.

In the oil venting position, as shown in FIG. 7B, pressurized oil from pump 166 is prevented from passing through lock pin control valve 164 to annular lock pin oil groove 170. At the same time, fluid communication is provided between annular lock pin oil grooved 170 and oil reservoir 180 in order to vent oil from primary and secondary lock pins 52, 60.

In operation and referring to FIG. 7A, when a change in phase relationship between camshaft 14 and the crankshaft of internal combustion engine 10 is desired, pressurized oil from internal combustion engine 10 is supplied to primary and secondary lock pins 52, 60 where the path taken by the pressurized oil is represented by arrows P. This is accomplished by placing lock pin control valve 164 in the oil supplying position using lock pin control valve actuator 168. In this way, pressurized oil is supplied from pump 166 to camshaft primary and secondary lock pin oil passages 172, 174 through annular lock pin oil groove 170. From camshaft primary and secondary lock pin oil passages 172, 174, the pressurized oil is supplied to primary and secondary lock pins 52, 60 respectively through rotor primary and secondary lock pin oil passages 176, 178 respectively. The pressurized oil supplied to primary and secondary lock pins 52, 60 causes primary and secondary lock pins 52, 60 to retract from primary and secondary lock pin seats 56, 64 respectively.

Figure 4B:
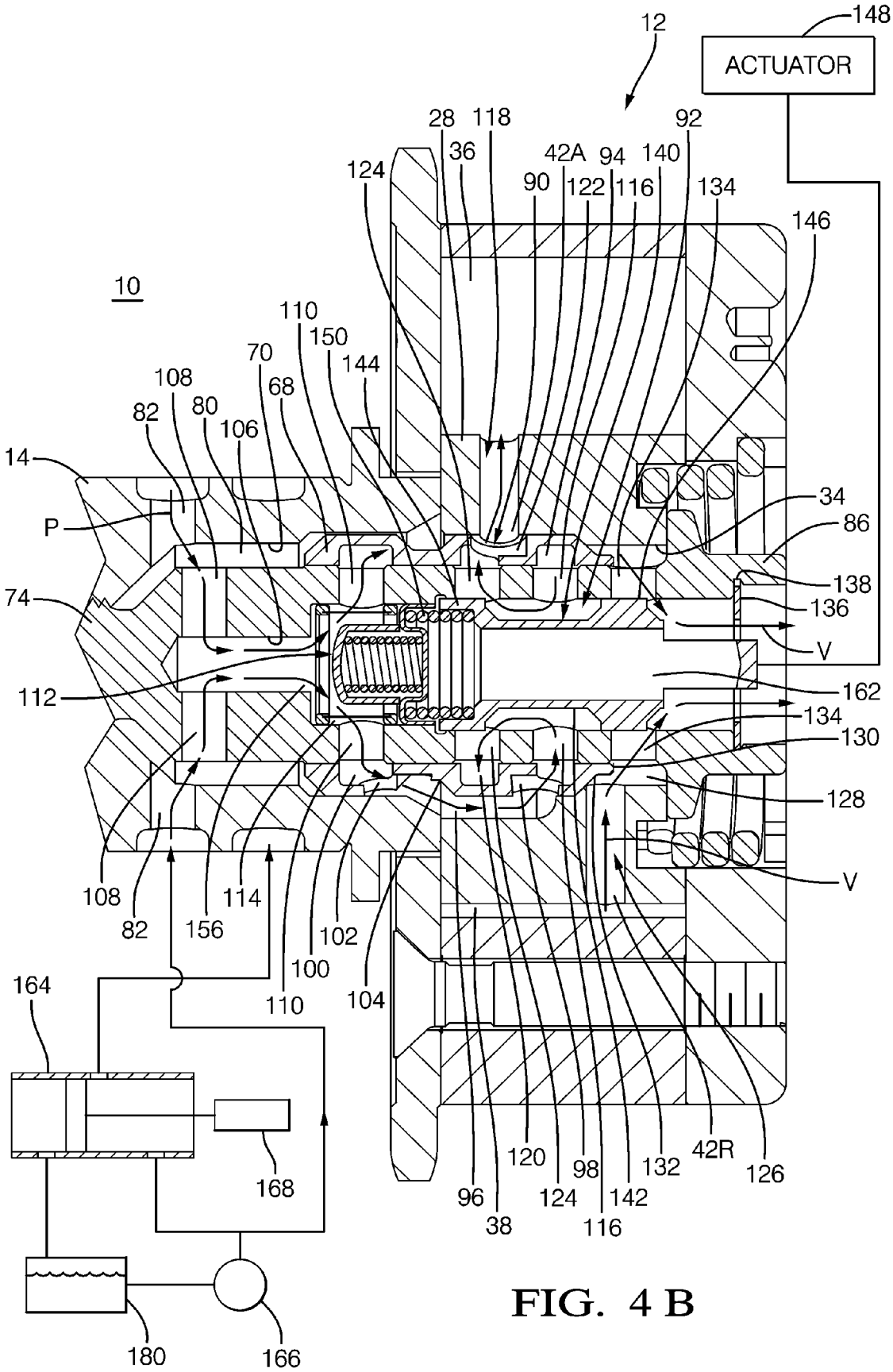
Figure 4:
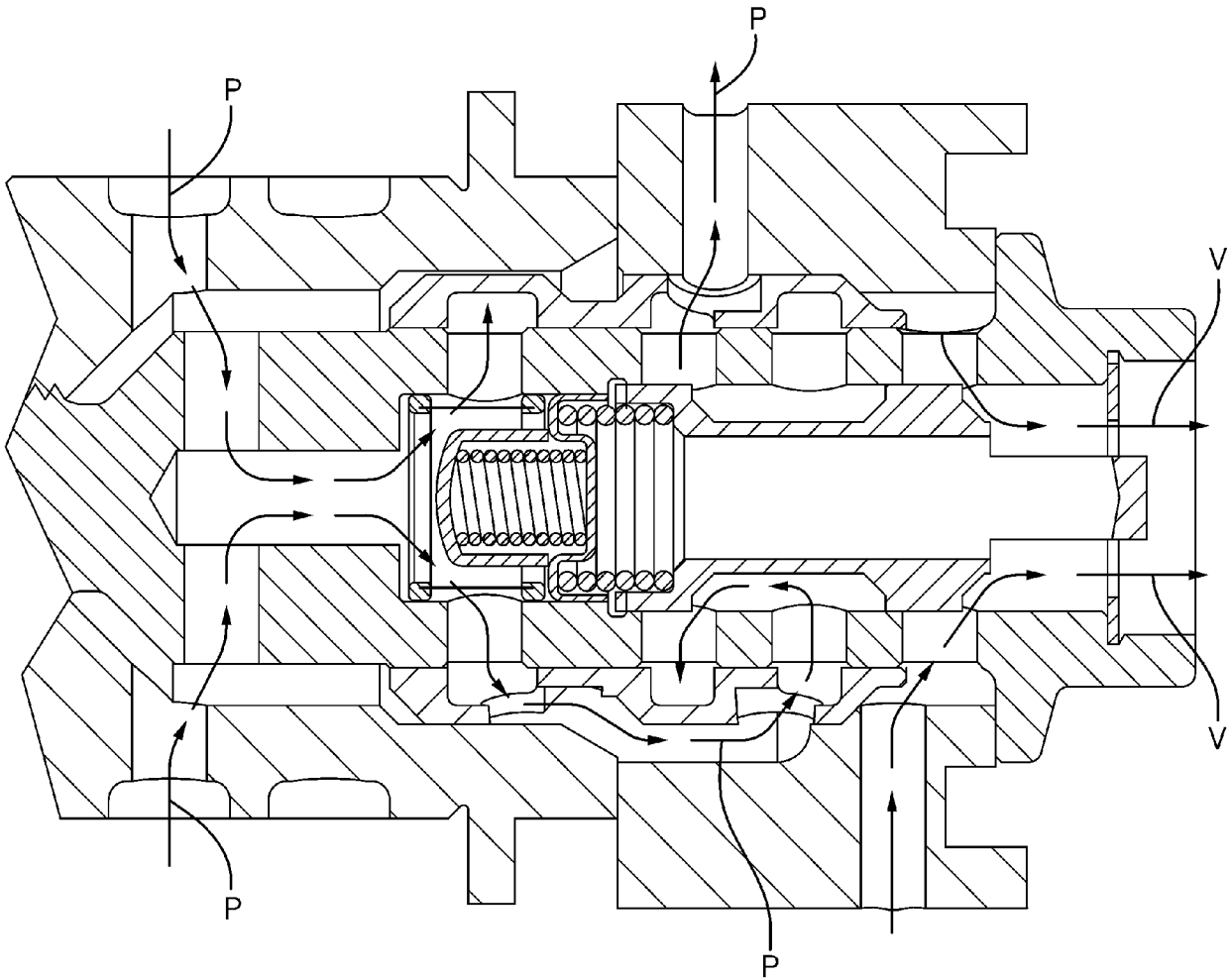
Figure 5A:
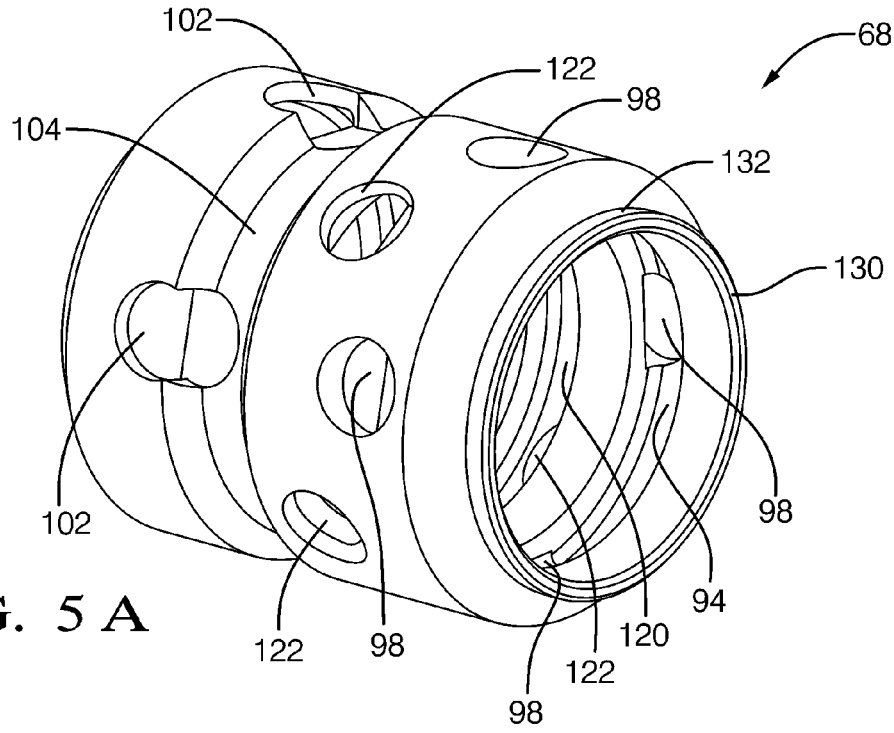
FIG. 5A is an enlarged isometric view of a bushing adaptor of the camshaft phaser of FIG. 1.
Figure 5B:
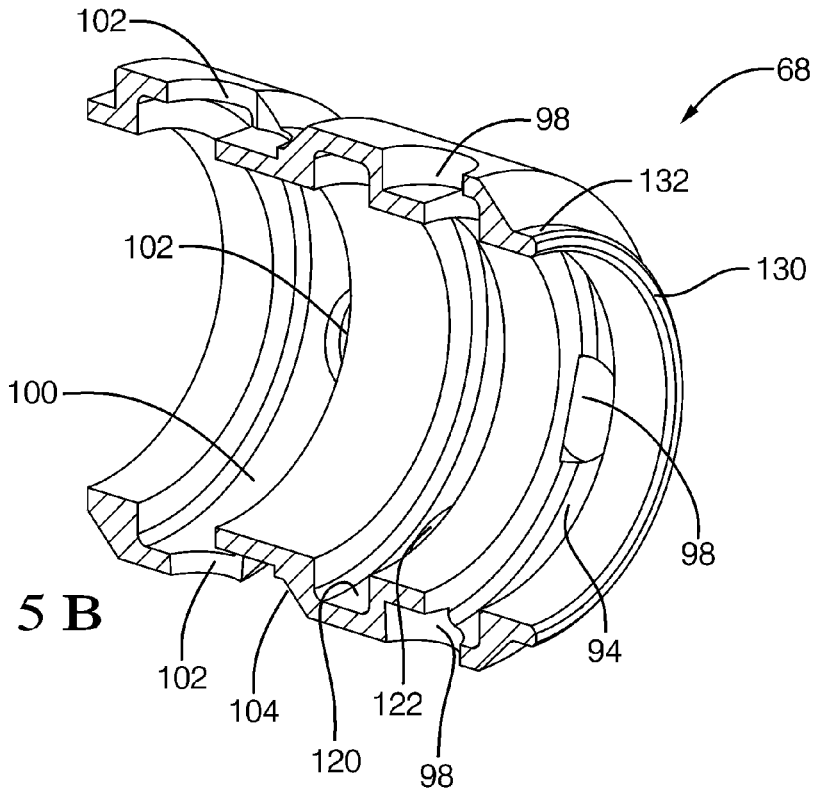
FIG. 5B is an isometric cross-section of the bushing adaptor of FIG. 5A.

With primary and secondary lock pins 52, 60 now retracted from primary and secondary lock pin seats 56, 64 respectively and referring to FIGS. 4A and 4B, the phase relationship between camshaft 14 and the crankshaft of internal combustion engine 10 can now be altered. This is accomplished by supplying pressurized oil to either the advance chambers 36 or to the retard chambers 38 while oil is vented from the chambers that are not receiving pressurized oil. Pressurized oil is supplied from pump 166 of internal combustion engine 10 to annular oil chamber 80 through camshaft phasing oil passages 82. The pressurized oil is then passed through first radial drillings 108 to check valve section 156 of blind bore 106 before passing through check valve assembly 112 and filter 114. The pressurized oil is then passed to second annular groove 100 through second radial drillings 110. From second annular groove 100, the pressurized oil is supplied to third annular groove 104 through second connecting passages 102. The pressurized oil is then supplied to first annular groove 94 through axial grooves 96 and first connecting passages 98. After reaching first annular groove 94, the pressurized oil is supplied to phase relationship control valve 92 through supply drillings 116.

If the pressurized oil is desired to be supplied to retard chambers 38, phase relationship control valve actuator 148 is placed in an unenergized state of operation as shown in FIG. 4A. In this state of operation, valve spool 140 is positioned within blind bore 106 to allow the pressurized oil to be communicated to retard drillings 134 from first connecting passages 98 where the path taken by the pressurized oil is represented by arrows P. Retard drillings 134 then communicate the pressurized oil to axial space 128 where the pressurized oil is then communicated to retard chambers 38 through oil passages 42R.

At the same time, the pressurized oil is prevented from being communicated from first connecting passages 98 to advance drillings 124 by advance land 144. Also at the same time, advance land 144 allows the oil to be vented from advance chambers 36 by placing advance drillings 124 in fluid communication with central passage 162 where the path taken by the vented oil is represented by arrows V. In this way, oil is allowed to be vented from advance chambers 36 through oil passages 42A. The vented oil then passes from oil passages 42A to fourth annular groove 120 through advance oil connecting passages 122. The oil is then communicated to central passage 162 through advance drillings 124 where the oil is then vented through the end of camshaft phaser attachment bolt 74. For clarity, FIG. 4A' is provided without reference numbers and without elements that do not define the oil passages to clearly show the path taken by the pressurized oil represented by arrows P and the path taken by the vented oil represented by arrows V.

However, if the pressurized oil is desired to be supplied to advance chambers 36, phase relationship control valve actuator 148 is placed in an energized state of operation as shown in FIG. 4B. In this state of operation, valve spool 140 is positioned within blind bore 106 to allow the pressurized oil to be communicated to advance drillings 124 from first connecting passages 98 where the path taken by the pressurized oil is represented by arrows P. Advance drillings 124 then communicate the pressurized oil to fourth annular groove 120 where the pressurized oil is then communicated to advance chambers 36 through advance oil connecting passages 122 and oil passages 42R.

At the same time, the pressurized oil is prevented from being communicated from first connecting passages 98 to retard drillings 134 by retard land 146. Also at the same time, retard land 146 allows the oil to be vented from retard chambers 38 by placing retard drillings 134 in fluid communication with central passage 162 where the path taken by the vented oil is represented by arrows V. In this way, oil is allowed to be vented from retard chambers 38 through oil passages 42R. The vented oil then passes from oil passages 42R to axial space 128 and then to central passage 162 through retard drillings 134. The oil is then vented through the end of camshaft phaser attachment bolt 74. For clarity, FIG. 4B' is provided without reference numbers and without elements that do not define the oil passages to clearly show the path taken by the pressurized oil represented by arrows P and the path taken by the vented oil represented by arrows V.

In operation and referring to FIG. 7B, when it is desired to lock rotor 28 at the predetermined angular position with respect to stator 20, oil is vented from primary and secondary lock pins 52, 60 in order to seat primary and secondary lock pins 52, 60 within primary and secondary lock pin seats 56, 64 respectively. This is accomplished by placing lock pin control valve actuator 168 in the oil venting position. In the oil venting position, pressurized oil from pump 166 is prevented from passing through lock pin control valve 164 to annular lock pin oil groove 170. At the same time, fluid communication is provided between annular lock pin oil groove 170 and oil reservoir 180. In this way, oil is vented from primary and secondary lock pins 52, 60 where the path taken by the vented oil is represented by arrows V. The oil vented from primary and secondary lock pins 52, 60 first passes to camshaft primary and secondary lock pin oil passages 172, 174 through rotor primary and secondary lock pin oil passages 176, 178 respectively. The oil is then passed to oil reservoir 180 through annular lock pin oil groove 170.

With the oil vented from primary and secondary lock pins 52, 60, primary and secondary lock pin springs 58, 66 urge primary and secondary lock pins 52, 60 respectively toward camshaft phaser cover 50. However, unless primary and secondary lock pins 52, 60 are already aligned with primary and secondary lock pin seats 56, 64 respectively, one or both of the primary and secondary lock pins 52, 60 will not be seated within primary and secondary lock pin seats 56, 64 respectively. In order to seat primary and secondary lock pins 52, 60 within primary and secondary lock pin seats 56, 64 respectively, the phase relationship between rotor 28 and stator 20 may need to be altered. This may be accomplished by supplying the pressurized oil to either advance chambers 36 or retard chambers 38 as needed to achieve the predetermined angular relationship of rotor 28 within stator 20. This may also be accomplished by allowing bias spring 44 to urge rotor 28 to the predetermined angular position. Furthermore, this may be accomplished by allowing torque from camshaft 14 to urge rotor 28 to the predetermined angular position. As described earlier, primary lock pin 52 will be seated within primary lock pin seat 56 first thereby holding rotor 28 near the predetermined angular position. Secondary lock pin 60 will then be seated within secondary lock pin seat 64 when secondary lock pin 60 is aligned with secondary lock pin seat 64.

While internal combustion engine 10 has been described as having camshaft phaser 12 applied to camshaft 14, it should now be understood that internal combustion engine 10 may include multiple camshafts and that each camshaft may include its own camshaft phaser. It should also be understood that one camshaft may use a camshaft phaser in accordance with the present invention, while the second camshaft phaser may be another type of camshaft phaser, for example, an electrically actuated camshaft phaser. It should also be understood that the present invention applies to both internal combustion engines with a single bank of cylinders and to internal combustion engines with multiple banks of cylinders.

The operation of camshaft phaser 12 has been described as supplying pressurized oil to retard chambers 38 when phase relationship control valve actuator 148 is not energized, while at the same time venting oil from advance chambers 36. It should now be understood that operation of camshaft phaser 12 could also be arranged to supply pressurized oil to advance chambers 36 when phase relationship control valve actuator 148 is not energized, while at the same time venting oil from retard chambers 38. Similarly, the operation of camshaft phaser 12 has been described as supplying pressurized oil to advance chambers 36 when phase relationship control valve actuator 148 is energized, while at the same time venting oil from retard chambers 38. It should now be understood that the operation of camshaft phaser 12 could also be arranged to supply pressurized oil to retard chambers 38 when phase relationship control valve actuator 148 is energized, while at the same time venting oil from advance chambers 36.

While this invention has been described in terms of preferred embodiments thereof, it is not intended to be so limited, but rather only to the extent set forth in the claims that follow.

We claim:

1. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator, said rotor having a plurality of vanes interspersed with said stator lobes defining alternating advance chambers and retard chambers, wherein said advance chambers receive pressurized oil in order to change the phase relationship between said crankshaft and said camshaft in the advance direction and said retard chambers receive pressurized oil in order to change the phase relationship between said camshaft and said crankshaft in the retard direction, said rotor being attachable to said camshaft of said internal combustion engine to prevent relative rotation between said rotor and said camshaft;

a lock pin disposed within one of said rotor and said stator for selective engagement with a lock pin seat in the other of said rotor and said stator for preventing a change in phase relationship between said rotor and stator when said lock pin is engaged with said lock pin seat, wherein pressurized oil is selectively supplied to said lock pin in order to disengage said lock pin with said lock pin seat, and wherein oil is selectively vented from said lock pin in order to engage said lock pin with said lock pin seat;

a phase relationship control valve located coaxially within said rotor for controlling the flow of oil into and out of said advance and retard chambers;

a first lock pin oil passage for communicating oil to and from said lock pin, wherein said first lock pin oil passage is in fluid communication with a lock pin oil control valve located outside of said camshaft phaser when said camshaft phaser is attached to said internal combustion engine, and wherein said lock pin oil control valve controls the flow of oil to and from said lock pin and is operated independently of said phase relationship control valve a bushing adaptor coaxially disposable within a pocket of said camshaft and coaxially disposed within said rotor; and a camshaft phaser attachment bolt extending coaxially through said bushing adaptor in a close fitting relationship and threadably engageable into said camshaft to attach said camshaft phaser to said camshaft;

wherein said bushing adaptor defines at least in part:

a supply passage for communicating pressurized oil from said internal combustion engine to said phase relationship control valve, said supply passage being defined at least in part by a first annular groove formed on the inside surface defining the inside diameter of said bushing adapter;

an advance passage for selectively communicating pressurized oil from said phase relationship control valve to said advance chambers; and a retard passage for selectively communicating pressurized oil from said phase relationship control valve to said retard chambers.

2. A camshaft phaser as in claim 1, wherein said first lock pin oil passage is located in said rotor and is in fluid communication with a second lock pin oil passage located in said camshaft when said rotor is connected to said camshaft.

3. A camshaft phaser as in claim 1 wherein said supply passage is further defined by an axial groove formed in one of the inside surface of said rotor and a cylindrical sleeve disposed coaxially between said rotor and said bushing adaptor, said axial groove being in fluid communication with said first annular groove through a first connecting passage extending radially through said bushing adaptor.

4. A camshaft phaser as in claim 3 wherein said supply passage is further defined by a second annular groove formed on the inside diameter of said bushing adapter, said second annular groove being in fluid communication with said axial groove through a second connecting passage extending radially through said bushing adaptor.

5. A camshaft phaser as in claim 4 wherein said second annular groove is disposable within said pocket of said camshaft.

6. A camshaft phaser as in claim 4 wherein said supply passage is further defined by a third annular groove formed on the outside diameter of said bushing adapter, said third annular groove being in fluid communication with said axial groove and said second connecting passage.

7. A camshaft phaser as in claim 1 wherein one of said advance passage and said retard passage is defined by a fourth annular groove formed on the inside diameter of said bushing adaptor.

8. A camshaft phaser as in claim 7 wherein the other of said advance passage and said retard passage is defined by an axial space formed between an axial end of said bushing adaptor and said camshaft phaser attachment bolt.

9. A camshaft phaser as in claim 1 wherein said camshaft phaser attachment bolt comprises an axial bore containing said phase relationship control valve.

10. A camshaft phaser as in claim 9 wherein said camshaft phaser attachment bolt comprises:

a first radial passage therethrough for communicating pressurized oil from said internal combustion engine to said axial bore; and a second radial passage therethrough for communicating pressurized oil from said axial bore to said supply passage of said bushing adaptor.

11. A camshaft phaser as in claim 10 wherein a check valve assembly is disposed between said first radial passage and said second radial passage whereby pressurized oil is allowed to be communicated from said first radial passage to said second radial passage and whereby pressurized oil is substantially prevented from being communicated from said second radial passage to said first radial passage.

12. A camshaft phaser as in claim 1 wherein said bushing adaptor coaxially aligns said camshaft phaser with said camshaft.

13. An internal combustion engine with a crankshaft and a camshaft, said internal combustion engine comprising:

a camshaft phaser for controllably varying the phase relationship between said crankshaft and the camshaft in said internal combustion engine, said camshaft phaser including a stator having a plurality of lobes and connected to said crankshaft of said internal combustion engine to provide a fixed ratio of rotation between said stator and said crankshaft; a rotor coaxially disposed within said stator, said rotor having a plurality of vanes interspersed with said stator lobes defining alternating advance chambers and retard chambers, wherein said advance chambers receive pressurized oil in order to change the phase relationship between said crankshaft and said camshaft in the advance direction and said retard chambers receive pressurized oil in order to change the phase relationship between said camshaft and said crankshaft in the retard direction, said rotor being attached to said camshaft of said internal combustion engine to prevent relative rotation between said rotor and said camshaft; a lock pin disposed within one of said rotor and said stator for selective engagement with a lock pin seat in the other of said rotor and said stator for preventing a change in phase relationship between said rotor and stator when said lock pin is engaged with said lock pin seat, wherein pressurized oil is selectively supplied to said lock pin in order to disengage said lock pin with said lock pin seat, and wherein oil is selectively vented from said lock pin in order to engage said lock pin with said lock pin seat; a phase relationship control valve located coaxially within said rotor for controlling the flow of oil into and out of said advance and retard chambers; a first lock pin oil passage for communicating oil to and from said lock pin; a bushing adaptor coaxially disposed within a pocket of said camshaft and coaxially disposed within said rotor; and a camshaft phaser attachment bolt extending coaxially through said bushing adaptor in a close fitting relationship and threadably engaged into said camshaft to attach said camshaft phaser to said camshaft; and a lock pin oil control valve located outside of said camshaft phaser and operated independently of said phase relationship control valve for controlling the flow of oil to and from said lock pin through said first lock pin oil passage;

wherein said bushing adaptor defines at least in part:

a supply passage for communicating pressurized oil from said internal combustion engine to said phase relationship control valve, said supply passage being defined at least in part by a first annular groove formed on the inside surface defining the inside diameter of said bushing adapter;

an advance passage for selectively communicating pressurized oil from said phase relationship control valve to said advance chambers; and a retard passage for selectively communicating pressurized oil from said phase relationship control valve to said retard chambers.

14. An internal combustion engine as in claim 13, wherein said first lock pin oil passage is located in said rotor and is in fluid communication with a second lock pin oil passage located in said camshaft.

15. An internal combustion engine as in claim 13 wherein said supply passage is further defined by an axial groove formed in one of the inside surface of said rotor and a cylindrical sleeve disposed coaxially between said rotor and said bushing adaptor, said axial groove being in fluid communication with said first annular groove through a first connecting passage extending radially through said bushing adaptor.

16. An internal combustion engine as in claim 15 wherein said supply passage is further defined by a second annular groove formed on the inside diameter of said bushing adapter, said second annular groove being in fluid communication with said axial groove through a second connecting passage extending radially through said bushing adaptor.

17. An internal combustion engine as in claim 16 wherein said second annular groove is disposed within said pocket of said camshaft.

18. An internal combustion engine as in claim 17 wherein said supply passage is further defined by a third annular groove formed on the outside diameter of said bushing adapter, said third annular groove being in fluid communication with said axial groove and said second connecting passage.

19. An internal combustion engine as in claim 13 wherein one of said advance passage and said retard passage is defined by a fourth annular groove formed on the inside diameter of said bushing adaptor.

20. A internal combustion engine as in claim 19 wherein the other of said advance passage and said retard passage is defined by an axial space formed between an axial end of said bushing adaptor and said camshaft phaser attachment bolt.

21. A internal combustion engine as in claim 13 wherein said camshaft phaser attachment bolt comprises an axial bore containing said control valve.

22. A internal combustion engine as in claim 21 wherein said camshaft phaser attachment bolt comprises:

a first radial passage therethrough for communicating pressurized oil from said internal combustion engine to said axial bore; and a second radial passage therethrough for communicating pressurized oil from said axial bore to said supply passage of said bushing adaptor.

23. An internal combustion engine as in claim 22 wherein a check valve assembly is disposed between said first radial passage and said second radial passage whereby pressurized oil is allowed to be communicated from said first radial passage to said second radial passage and whereby pressurized oil is substantially prevented from being communicated from said second radial passage to said first radial passage.

24. An internal combustion engine as in claim 13 wherein said bushing adaptor coaxially aligns said camshaft phaser with said camshaft.

* * * * *